United States Patent [19]

Campagna et al.

[11] 4,394,716

[45] Jul. 19, 1983

[54] SELF-CONTAINED UNDERWATER LIGHT ASSEMBLY

[75] Inventors: Thomas G. Campagna; Alfred A. D'Andrea, Sr., both of Selden; Frank Campagna, East Northport, all of N.Y.

[73] Assignee: Aqualume, Incorporated, Selden, N.Y.

[21] Appl. No.: 224,676

[22] Filed: Jan. 13, 1981

[51] Int. Cl.[3] ..... F21L 11/00

[52] U.S. Cl. ..... 362/158; 362/186; 362/267; 362/295

[58] Field of Search ..... 362/158, 208, 267, 217, 362/295, 186

[56] References Cited

U.S. PATENT DOCUMENTS

| | | | |
|---|---|---|---|
| 2,051,175 | 8/1936 | Nightingale | 362/267 |
| 2,097,357 | 10/1937 | Watts | 362/267 |
| 2,906,863 | 9/1959 | Ritter | 362/267 |
| 3,339,066 | 8/1967 | Hart | 362/267 |
| 3,456,103 | 7/1969 | Bond | 362/267 |
| 3,474,243 | 10/1969 | Miller | 362/267 X |
| 3,748,457 | 7/1973 | Balitzky et al. | 362/158 |
| 3,864,562 | 2/1975 | Hawkins | 362/267 X |
| 4,053,758 | 10/1977 | Shaw | 362/158 |
| 4,186,432 | 1/1980 | Hamacher | 362/267 X |
| 4,216,411 | 8/1980 | Ehret et al. | 362/267 X |
| 4,234,913 | 11/1980 | Ramme | 362/158 |
| 4,293,847 | 10/1981 | McCarty | 362/267 X |

*Primary Examiner*—Peter A. Nelson

*Attorney, Agent, or Firm*—Alfred A. D'Andrea, Jr.

[57] ABSTRACT

An underwater light assembly for internal illumination of swimming pools and the like which operates on batteries and does not require any externally-provided current. A partitioned compartment is detachably engaged within and against a transparent dome. The compartment houses weights to keep the assembly submerged in a pool of water. The compartment also houses the batteries and a power assembly for providing current to a lamp socket. The lamp socket is suspended within the compartment. A detachable seal is provided to seal the compartment within and against the transparent dome. A metal contact plate is provided on the detachable seal such that, when the seal is inserted and seals the compartment within and against the transparent dome, an electrical connection is completed and the power assembly supplies current to the lamp socket. The underwater light assembly may be constructed for either incandescent or fluorescent lamps, rests on the bottom of the pool of water and may be adapted for mounting on the side wall enclosing the pool of water.

14 Claims, 6 Drawing Figures

SELF-CONTAINED UNDERWATER LIGHT ASSEMBLY

BACKGROUND OF THE INVENTION

The present invention relates to underwater light assemblies and, more particularly, to an underwater light assembly which allows for the internal illumination of a body of water, such as water in a backyard swimming pool, without requiring the use of an external source of current.

Various systems are in current usage for lighting a body of water such as water in a swimming pool. For example, light assemblies are mounted on poles, or attached to the decks of swimming pools, surrounding fences, or trees, and focused on the body of water. Common to all these systems is the use of live current from an external source, most often house current, for operation of the assemblies.

The problems inherent in such systems are manifold. Lights placed near the body of water create a danger of accidental electrocution or fire through contact of the water, which tends to get scattered and splashed around the area, and the light assemblies and lines supplying current to the light assemblies. Current lines must be buried in the ground to the extent possible. Nevertheless, a certain length of line must come out of the ground up to the light assembly. Costly insulation or piping systems must be installed and regularly monitored to minimize the potential danger, which is never completely eliminated, as well as to meet housing and fire codes.

Alternatively, light assemblies must be mounted far away from the body of water, resulting not only in lighting of the body of water but also in general lighting of surrounding areas and placing of added current requirements on the system. This is costly, eliminates privacy and diminishes the aesthetic experience of evening swimming.

Underwater flashlights that operate on batteries and are waterproof are well-known. Among the deficiencies of such flashlights, however, are that they must be hand-held, provide only narrow, focused lighting and are not capable of internal illumination of the entire body of water in, for example, a swimming pool.

The present invention provides an underwater light assembly that can be submerged in a pool of water, such as water in a swimming pool, for internal illumination of the pool of water, which does not require any house current or other externally-provided source of current and does not have to be grounded.

The present invention provides an underwater light assembly that can be submerged in a pool of water for direct localized internal illumination of the pool of water without the attendant risks or electrocution or fire present in prior art lighting assemblies requiring external sources of current.

The present invention provides an underwater light assembly that provides safe, inexpensive and decorative lighting of fish ponds, water fountains, fish tanks and the like.

The present invention provides a relatively compact and inexpensive underwater light assembly eliminating the necessity for externally-provided sources of current in illuminating a pool of water.

The present invention provides an underwater light assembly that provides localized lighting from within a pool of water without generally lighting surrounding areas and eliminates the unsightly appearance of external light assemblies, poles and current lines.

The present invention provides a light assembly that can be used anywhere, in or out of water, to provide a self-contained light source eliminating the necessity for externally-provided current.

SUMMARY OF THE INVENTION

The light assembly of the present invention provides for the underwater illumination of a body of water, such as water in a swimming pool, without requiring the use of any house current or other externally-provided source of current.

The underwater light assembly generally comprises a transparent shell means, a lamp socket means, compartment means detachably secured within and against the transparent shell means for housing a power assembly means, weights and the lamp socket means, means for detachably securing the compartment means within and against the transparent shell means, power assembly means for securing a source of current within the compartment means and for supplying current to the lamp socket means, detachable seal means for sealing the compartment means within an area of the transparent shell means, and means for switching on and off the current supplied to the lamp socket means by the power assembly means when a source of current is installed in the power assembly means.

Preferably, the transparent shell means, the compartment means, the means for detachably securing the compartment means within and against the transparent shell means, and the detachable seal means are all made of plastic. It is preferred that the transparent shell means be in the shape of a dome and that the compartment means comprise separate compartments for housing weights, the power assembly means and the lamp socket means.

The lamp socket means may comprise a lamp socket for either an incandescent or fluorescent lamp. Similarly, the power assembly means is chosen to provide either direct or alternating current, depending on whether the lamp socket means is for, respectively, an incandescent or fluorescent lamp.

It is also preferred that the means for detachably securing the compartment means within and against the transparent shell means comprise the detachable shell means itself, although the means for detachably securing may be comprised of means other than the detachable seal means.

Preferably, there is also provided means for preventing rotation of the compartment means within the transparent shell means. There is also preferably provided means for mounting the underwater light assembly.

DESCRIPTION OF THE PREFERRED EMBODIMENT

Figures 1, 2:
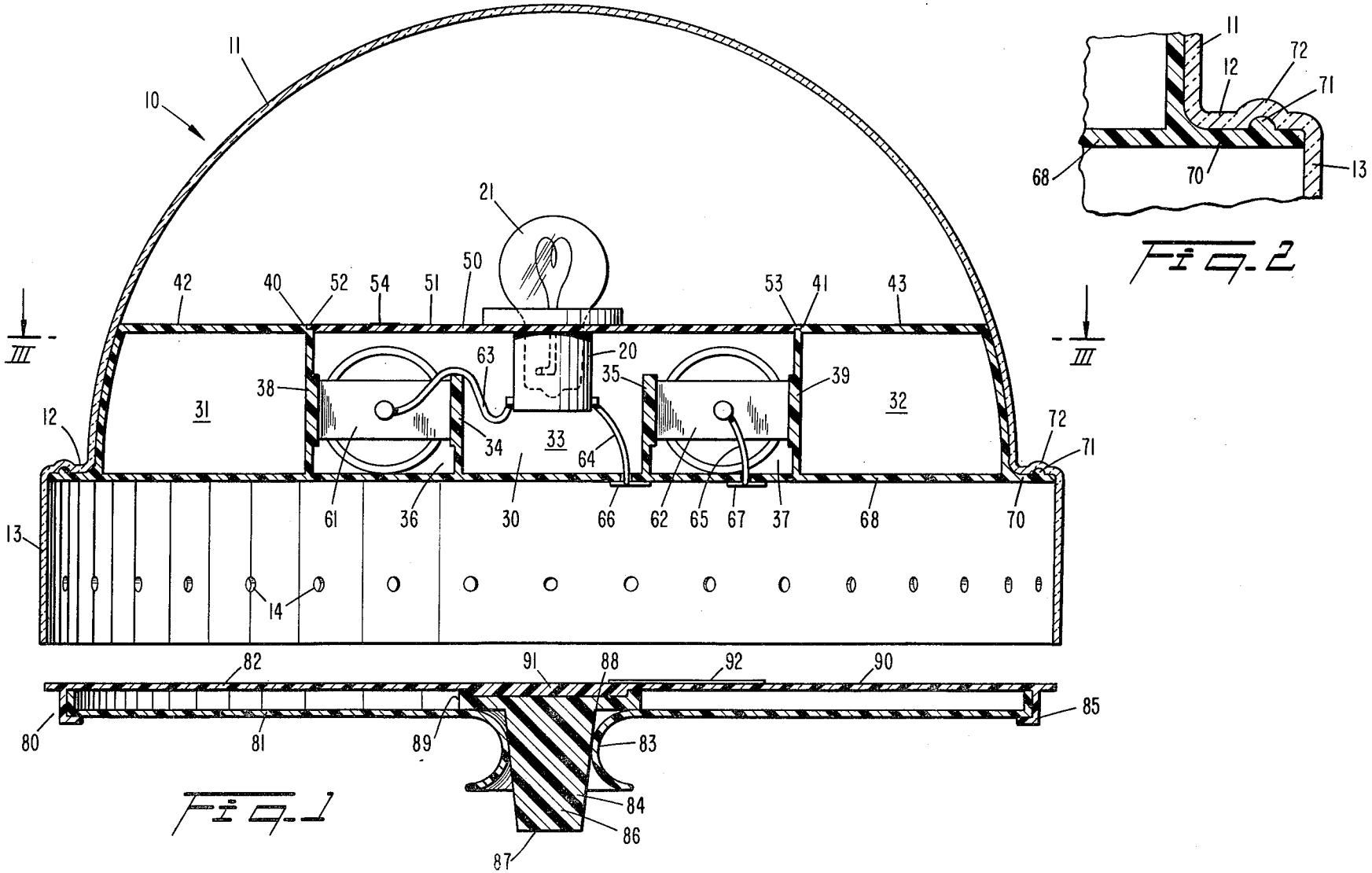
FIG. 1 is a cross section of one embodiment of the underwater light assembly of the present invention.
FIG. 2 is a detail of the engagement of the compartment means and the transparent shell means shown in FIG. 1.

Referring to FIG. 1, there is shown one embodiment of the underwater light assembly of the present invention. As shown in FIG. 1, a light assembly, broadly denoted as 10, is provided for submerged placement within a body of water such as a swimming pool.

In accordance with the invention, the underwater light assembly includes transparent shell means. As here embodied and as depicted in FIG. 1, the transparent shell means comprises a transparent dome 11 integrally formed with a protruding lip 12 and an apron base 13. Protruding lip 12 and apron base 13 extend circumferentially around the entire periphery of dome 11 and are formed of the same material as dome 11. Dome 11 is made of a clear or transparent impact-resistant plastic such as the rigid plastic used in commercially-available tupperware products. Protruding lip 12 is formed at an angle of approximately ninety degrees with dome 11, and apron base 13 is formed at an angle of approximately ninety degrees with protruding lip 12.

It is preferred that apron base 13 include a plurality of apertures 14 around its periphery. Apertures 14 will facilitate submergence of the underwater light assembly in a pool of water by allowing drainage of water from the inner area defined by the apron base 13.

While the transparent shell means as here embodied is in the shape of a dome, any shape can be employed in accordance with the invention. For example, the shape of the transparent shell means can also be square, oblong, cylindrical, octangular, star-shaped, or clam-shaped. Moreover, the transparent shell means may be constructed of any impact-resistant plastic or synthetic material.

In accordance with the invention, the underwater light assembly includes lamp socket means. As here embodied and as depicted in FIG. 1, the lamp socket means comprises a conventional spring-loaded, push-and-twist socket 20 for holding an incandescent lamp 21. While a specific incandescent lamp socket is depicted in FIG. 1, the lamp socket means of the present invention may comprise any known socket for either incandescent or fluorescent lamps.

In accordance with the invention, the underwater light assembly furhter includes compartment means detachably secured within and against the transparent shell means for housing a power assembly means, weights and the lamp socket means. As here embodied and as depicted in FIG. 1, the compartment means comprises a molded rigid plastic compartment assembly 30.

Compartment assembly 30 includes two enclosed outer compartments 31, 32 for enclosing weights such as sand or lead. The amount of weight enclosed in compartments 31, 32 is chosen to ensure that the light assembly 10 remains submerged when placed underwater, for example, on the bottom of a swimming pool. Compartment assembly 30 also includes a middle compartment 33, defined by two rigid plastic walls 34, 35, into which the lamp socket means projects, as will be described hereinafter. Additionally, compartment assembly 30 has two compartments 36, 37, defined by rigid walls 34, 35 and the side rigid plastic walls 38, 39 of weight compartments 31, 32, for housing power assembly means, which will be described fully hereinafter.

Compartment assembly 30 further includes dovetailed lips 40, 41, formed respectively at the junction of plastic walls 38, 42 and 39, 43, the function and purpose of which will be described shortly.

Preferably, the upper surface of top rigid plastic walls 42, 43 of outer compartments 31, 32 is coated with a reflective material to enhance the light reflection from lamp 21 through the water.

The specific number and location of the compartments in the compartment means of the present invention is not critical and may vary widely. For example, a single compartment can be used for housing the weights and a single compartment for housing the power assembly means. Similarly, more than two compartments can be used for housing each of the weights and power assembly means. Likewise, the specific shape of the compartment means is not critical, as long as it conforms to the shape of the shell means so that it can be inserted within the shell means. The compartment means can be made of any rigid plastic or synthetic material.

Compartment assembly 30 further includes a rigid plastic plate 50. Lamp socket 20 is attached to and supported from this rigid plate 50.

Preferably, the upper surface 51 of rigid plate 50 is coated with a reflective material to enhance the light reflection from lamp 21 through the water.

Rigid plate 50 has dovetailed ends 52, 53. Dovetailed ends 52, 53 engage the dovetailed lips 40, 41, thus detachably securing lamp socket 20 in place above and in compartment 33. Rigid plate 50 can thus be removed for installation, testing, or replacement of the power assembly means in compartments 36, 37, which means will be described shortly.

Rigid plate 50 can be made of any rigid plastic or synthetic material, as long as it has a slight bend or give to it under hand pressure in order to facilitate attachment to and detachment from compartment assembly 30. Preferably, a knurled patch 54 is provided on plate 50 to facilitate attachment and detachment.

It is preferred that plate 50 be detachable from compartment assembly 30. However, plate 50 can be constructed as an integral part of compartment assembly 30 as long as access is provided to the power assembly means within the compartment means. For example, plate 50 may be apertured so that access may be had to the power assembly means. Alternatively, floor 68 may be detachably secured to compartment assembly 30 to provide access to the power assembly means. For example, floor 68 may comprise a snap-on floor.

In accordance with the invention, the compartment means further includes means for abutting the transparent shell means. As here embodied and as depicted in FIG. 1, the means for abutting the transparent shell means comprises a protruding extension 70 formed integrally with and peripherally surrounding floor 68 of compartment assembly 30. Insertion of compartment assembly 30 within transparent dome 11 causes protruding extension 70 to abut against protruding lip 12 of the transparent shell means, thus engaging the transparent dome 11 and compartment assembly 30.

While the means for abutting the transparent shell means as here embodied comprises a continuous peripheral protruding extension, other variations may be employed as long as the compartment means abuts the transparent shell means. For instance, the means for abutting the transparent shell means may comprise discrete tabs protruding from the compartment assembly floor 68 at various discrete locations around the periphery of the compartment assembly 30.

In accordance with the invention, the underwater light assembly may include means for preventing rotation of the compartment means within the transparent shell means. As here embodied and as depicted in FIG. 2, the means for preventing rotation of the compartment means within the transparent shell means comprises nipples 71 and recesses 72.

As shown in FIGS. 1 and 2, protruding extension 70 is provided at various points around its periphery with nipples 71 and protruding lip 12 is provided at corresponding points around its periphery with recesses 72. The engagement of nipples 71 and recesses 72 prevents compartment assembly 30 from rotating within transparent dome 11 and gives added security to the assembly.

Alternatively, where the means for abutting comprises discrete tabs, protruding lip 12 may be provided with recesses corresponding in shape and size to the discrete tabs. Accordingly, when compartment assembly 30 is inserted within the transparent shell means, the discrete tabs fit into the recesses provided on protruding lip 12, whereby the compartment assembly both abuts and is prevented from rotating within the transparent shell means.

It is preferred that the underwater light assembly of the present invention includes means for preventing rotation of the compartment means within the transparent shell means. However, such means are not essential to a practice of the invention because the detachable seal means, which will be described hereinafter, acts to prevent the compartment means from rotating within the compartment means. Nevertheless, the preferred rotation-preventing means of the present invention gives added insurance that the compartment means will remain fixed within the transparent shell means.

Figure 3:
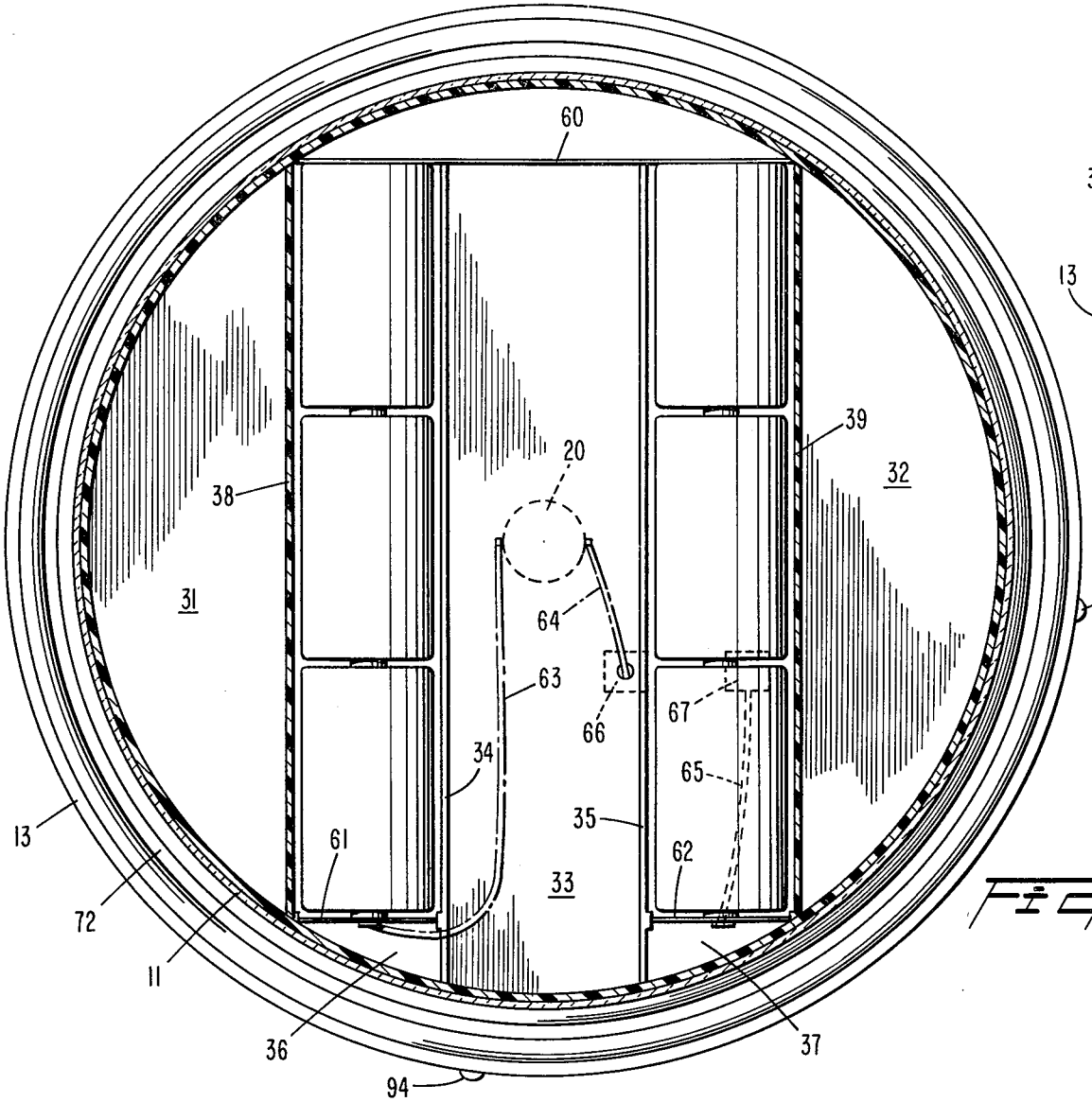
FIG. 3 is a cross section taken along the line III—III of FIG. 1.

In accordance with the invention, the underwater light assembly further includes power assembly means for securing a source of current within the compartment means and for supplying current to the lamp socket means. As here embodied and as depicted in FIGS. 1 and 3, the power assembly means comprises a brass spring-loaded plate 60, brass plates 61 and 62, electrical connection wires 63, 64, 65, and metal contact patches 66 and 67.

Spring-loaded brass plate 60 is secured between compartments 36 and 37. Brass plates 61 and 62 are secured, respectively, in each of compartments 36 and 37. A set of batteries can thus be secured in series within compartment assembly 30, three in compartment 36 between brass plates 60 and 61 and three in compartment 37 between brass plates 60 and 62. Compartments 36, 37 and brass plates 60, 61, 62 can be designed in any conventional manner to accomodate any known battery or other self-contained current source.

Metal contact patches 66 and 67 are each secured to the underside of floor 68 of compartment assembly 30. Electrical connection wire 63 runs from lamp socket 20 to brass plate 61, electrical connection wire 64 runs from lamp socket 20 to metal contact patch 66, and electrical connection wire 65 runs from brass plate 62 to metal contact patch 67.

Accordingly, interconnection of metal contact patches 66 and 67, as will be described hereinafter, completes the electrical circuit formed by the batteries, brass plates, metal contact patches and electrical wires just-described, thus providing current to lamp socket 20.

When access is provided to the power assembly means by detachably securing floor 68 to compartment assembly 30, metal contact patches 66 and 67 are secured to the interior of compartment assembly 30 such that they protrude slightly through apertures in floor 68. Accordingly, floor 68 can be removed for access to the power assembly means without requiring disassembly of the power assembly means, for example, without requiring disassembly of the electrical connection wires and metal contact patches. When floor 68 is secured to compartment assembly 30, metal contact patches 66 and 67 will protrude therethrough to facilitate their subsequent connection.

While a specific power assembly means has been embodied herein, other power assembly means for securing a source of current within the compartment means and for supplying current to the lamp socket means are suitable for use in the present invention. Since fluorescent lamps operate on alternating current, any power assembly means for fluorescent lamps must include a direct current hook-up with a converter means for converting direct current to alternating current, as is well-known in the art.

Figure 4:
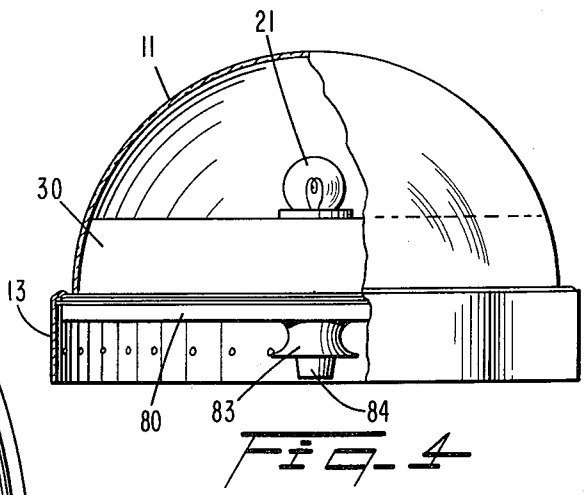
FIG. 4 is a side view of the assembled underwater light assembly shown in FIG. 1.

In accordance with the invention, the underwater light assembly further includes detachable seal means for sealing the compartment means within an area of the transparent shell means. As here embodied and as depicted in FIGS. 1 and 4, the detachable seal means comprises a push-in air seal, broadly denoted as 80.

Push-in air seal 80 includes a rigid plate 81 and a pliable casing 82. Rigid plate 81 can be made from any rigid material, and is preferably made from a rigid plastic or synthetic material. Pliable casing 82 is preferably made from any pliable but resilient plastic or synthetic material. Pliable casing 82 is detachably secured to rigid plate 81 by means of curved lip 85, which freely secures casing 82 to plate 81.

Push-in air seal 80 further includes a rigid knob 83 and a rigid plunger 84.

Rigid knob 83 is formed integrally with rigid plate 81 and is made from the same material as rigid plate 81. Rigid knob 83 forms a handle for hand grasping of the detachable seal means. Rigid plate 81 and rigid knob 83 are apertured through their centers to form a single aligned hole therethrough.

Although as here embodied rigid knob 83 is formed integrally with and made of the same material as rigid plate 81, rigid knob 83 can be made from any rigid material. Preferably, rigid knob 83 is made of plastic or other synthetic material. However, knob 83 can also be made from other rigid waterproof materials such as a treated wood. Moreover, knob 83 is preferably but not necessarily made integral with and of the same material as rigid plate 81, but can also be made of a different material and as a separate piece and then attached or adhered to plate 81.

Rigid plunger 84 comprises a stem 86 having one end 87 extending freely through and beyond the apertures in plate 81 and knob 83, and a second end 88 integrally formed with a button 89. Button 89 has a wider diameter than the apertures in plate 81 and knob 83. One side of button 89 is slightly hollowed and snaps onto a circular lip 91 of pliable casing 82. Thus, plunger 84 is detachably secured to pliable casing 82. The other side of button 89 rests freely against rigid plate 81.

Rigid plunger 84 can be made from any rigid, waterproof material. Preferably, rigid plunger 84 is made of a plastic or other synthetic material. However, it can also be made from other rigid, waterproof materials such as a treated wood.

Rigid knob 83 and rigid plunger 84 are so dimensioned that they do not protrude below the bottom of apron base 13 when push-in air seal 80 is inserted within the transparent shell means. Accordingly, the entire underwater light assembly sits securely on apron base 13.

In accordance with the invention, the underwater light assembly includes means for detachably securing the compartment means within and against the transparent shell means. As here embodied and as depicted in FIG. 1, the means for detachably securing comprises push-in air seal 80. Hence, as here embodied, push-in air seal 80 serves the dual function of sealing compartment assembly 30 within transparent dome 11 as well as detachably securing the compartment assembly 30 within and against the transparent dome 11.

It is preferred that the means for detachably securing the compartment means within and against the transparent shell means comprise the detachable seal means, since it is most convenient and simple in such case to remove the compartment means from within the transparent shell means. However, the compartment means may be detachably secured within and against the transparent shell means in other ways. For example, with respect to the underwater light assembly as embodied in FIGS. 1 to 4, protruding extension 70 and protruding lip 12 may be provided with aligned apertures at various points around their peripheries and plastic nuts and bolts placed therein for securing compartment assembly 30 to transparent dome 11.

In accordance with the invention, the underwater light assembly further includes means for switching on and off the current supplied to the lamp socket means by the power assembly means when a source of current is installed in the power assembly means. As here embodied and as depicted in FIG. 1, the switching means comprises a metal contact plate 92 attached or adhered to surface 90 of push-in air seal 80.

When push-in air seal 80 is inserted within dome 11, metal contact plate 92 completes the electrical circuit through metal contact patches 66 and 67, thus allowing the flow of current to the lamp socket means from the power assembly means.

To facilitate alignment of metal contact plate 92 so that it connects metal contact patches 66 and 67, push-in air seal 80 includes a slash mark(not shown) and apron base 13 includes "on" and "off" marks 94 and 95, respectively. Accordingly, alignment of the seal slash mark with "on" mark 94 aligns metal contact plate 92 to connect patches 66 and 67, while alignment of the seal slash mark with "off" mark 95 aligns plate 92 such that patches 66 and 67 are not connected and current does not flow to the lamp socket means.

The assembly and operation of the embodiment of the underwater light assembly shown in FIGS. 1 to 4 will now be described.

Batteries are placed in compartments 36, 37 of compartment assembly 30, a lamp is inserted in lamp socket 20 and the plastic plate 50 secured in place on compartment assembly 30. Compartment assembly 30 is then placed within transparent dome 11 and protruding lip 12 engages protruding extension 70. Knob 83 is grasped by hand and plunger 84 depressed. The pressure of plunger 84 against surface 90 of pliable casing 82 causes push-in air seal 80 to assume a concave shape of slightly reduced diameter. The seal is then inserted within dome 11. Plunger 84 is released and seal 80 resumes its original shape, forming a secure tight seal against apron base 13 of dome 11 and sealing and securing compartment assembly 30 within and against dome 11 by securing protruding extension 70 against protruding lip 12. Interengagement of nipples 71 and recesses 72 further secures compartment assembly 30 in place. Metal contact plate 92 is aligned to connect metal contact patches 66 and 67, thus completing the electrical circuit, and current is supplied to lamp socket 20.

The underwater light assembly is then submerged in a pool of water and is maintained submerged by the weights in compartments 31 and 32 of compartment assembly 30, the weights preventing the assembly from floating to the surface. The result is an underwater light assembly providing localized illumination of the pool of water from within and eliminating the necessity for any external source of current.

Figure 5:
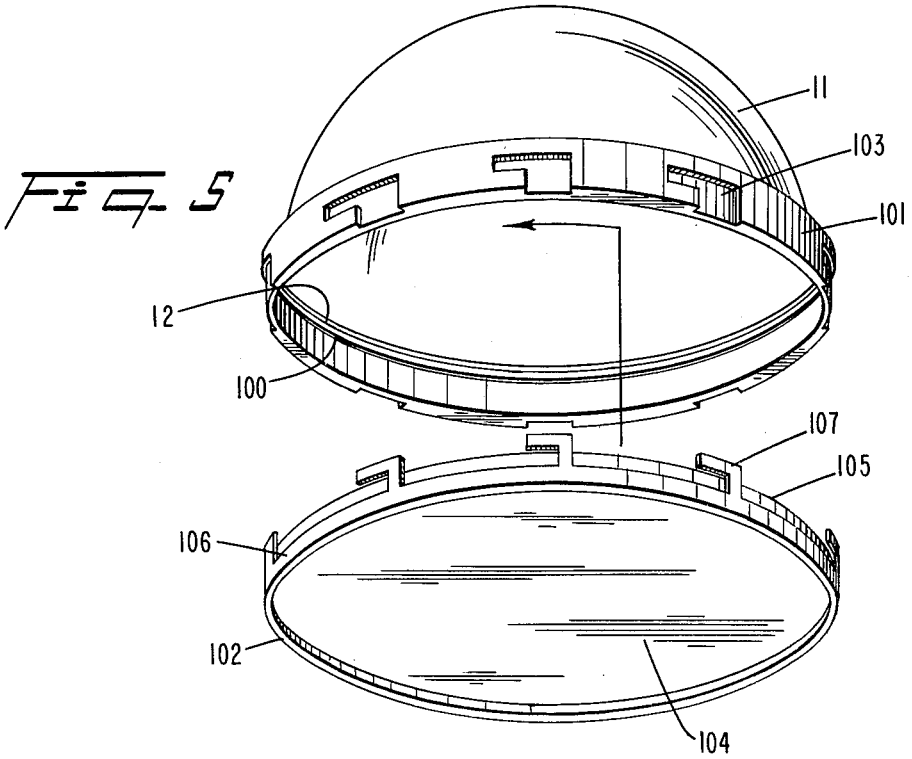
FIG. 5 is a perspective view of a second specific embodiment of the detachable seal means of the underwater light assembly of the present invention.

A second specific embodiment of the detachable seal means for sealing the compartment means within an area of the transparent shell means is depicted in FIG. 5. As here embodied and as depicted in FIG. 5, the detachable seal means comprises O-ring gasket 100, apron locking skirt 101 and locking base 102.

Apron locking skirt 101 corresponds to apron base 13 shown in FIG. 1. Additionally, however, apron locking skirt 101 includes L-shaped locking recesses 103. Locking base 102 includes base 104, inner rim 105, and outer rim 106 having L-shaped locking members 107.

The remaining elements of the underwater light assembly are the same as those shown in the FIGS. 1–4 embodiment. The assembly of the FIG. 5 embodiment will now be described.

Compartment assembly 30 is inserted within transparent dome 11 and protruding extension 70 of compartment floor 68 engages or abuts protruding lip 12. O-ring gasket 100 is inserted within transparent dome 11 against protruding extension 70 of floor 68. Locking base 102 is attached by aligning locking members 107 with locking recesses 103, pushing locking base 102 upward so that locking members 107 go up into locking recesses 103, and then twisting base 102 to securely engage locking members 107 in locking recesses 103. Inner rim 105 of locking base 102 engages O-ring 100 to maintain compartment assembly 30 securely against protruding lip 12 and hence within transparent dome 11.

Figure 6:
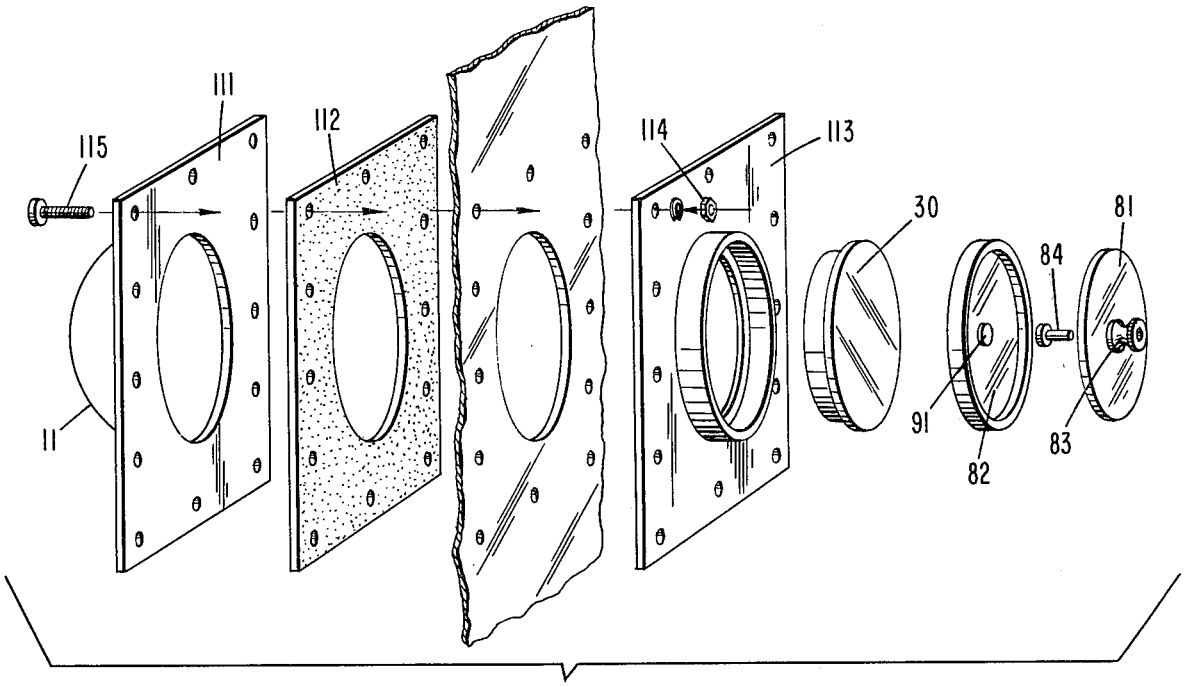
FIG. 6 is an exploded perspective view of a second embodiment of the underwater light assembly of the present invention adapted to be mounted on a wall such as the side wall of a swimming pool.

In accordance with the invention, the underwater light assembly may include means for mounting the underwater light assembly. As here embodied and as depicted in FIG. 6, the means for mounting comprises inner plate 111, gasket 112, outer plate 113, and nuts and bolts 114,115.

Inner plate 111 and outer plate 113 can be made of any rigid plastic or synthetic material.

Inner plate 111, gasket 112, and outer plate 113 are all apertured. The apertures of gasket 112 and outer plate 113 are of the same size, which is slightly greater in diameter than the aperture of inner plate 111. Transparent dome 11 is either formed integrally with or adhered to inner plate 111.

A hole is cut through a wall, such as the wall of a backyard swimming pool, equal in diameter to the apertures of gasket 112 and outer plate 113. Inner plate 111 and gasket 112 are attached to the inside of the swimming pool wall, and outer plate 113 is attached to the outside of the swimming pool wall, by means of nuts and bolts 114, 115, respectively. Compartment assembly 30 is then inserted through outer plate 113, gasket 112 and inner plate 111, respectively, into transparent dome 11. The diameter of compartment assembly 30 is selected such that it fits into inner plate 111, with protruding extension 70 of floor 68 engaging against inner plate 111, which functions as protruding lip 12 described earlier.

The larger diameter gasket 112 and outer plate 113 function as apron base 13 described earlier. Accordingly, push-in air seal 80, of a selected diameter corresponding to that of gasket 112 and outer plate 113, forms a secure tight seal within and against gasket 112 and outer plate 113 while securing compartment assembly 30 within dome 11 by securing extension 70 against the smaller diameter inner plate 111.

The means for mounting provides beneath the water surface, side-mounting of the underwater light assembly of the present invention, eliminating the need for weights in the compartment means and the presence of the underwater light assembly on the floor of the pool of water. This is especially beneficial in swimming pools since it eliminates the possibility of users accidentally kicking or tripping over the underwater light assembly.

What is claimed is:

1. A self-contained underwater light assembly comprising, (a) transparent shell means;

(b) lamp socket means;

(c) compartment means detachably secured within and against the transparent shell means for housing a power assembly means, weights and the lamp socket means;

(d) means for detachably securing the compartment means within and against the transparent shell means;

(e) power assembly means secured within the compartment means for securing a source of current within the compartment means and for supplying current to the lamp socket means;

(f) detachable seal means for sealing the compartment means within an area of the transparent shell means; and (g) means for switching on and off the current supplied to the lamp socket means by the power assembly means when a source of current is installed in the power assembly means.

2. The underwater light assembly according to claim 1 wherein the lamp socket means comprises fluorescent lamp socket means.

3. The underwater light assembly according to claim 1 wherein the lamp socket means comprises incandescent lamp socket means.

4. The underwater light assembly according to claim 1 wherein the compartment means includes at least one compartment containing weights to keep the light assembly submerged when placed in water, at least one compartment containing the power assembly means, and a compartment into which the bottom of the lamp socket means projects.

5. The underwater light assembly according to claim 1 wherein the compartment means includes a plate supporting the lamp socket means and having a reflective surface and dovetailed ends, and wherein the compartment means further includes means having dovetailed lips for engaging the dovetailed ends, thereby detachably securing the plate to the compartment means and suspending the lamp socket means above and in the compartment means.

6. The underwater light assembly according to claim 1 wherein the detachable seal means comprises (1) a rigid plate having means defining an aperture therethrough, (2) rigid knob means connected to the rigid plate for grasping the seal means, the knob means having means defining an aperture therethrough aligned with the aperture in the rigid plate, (3) a pliable casing covering at least one side of the rigid plate and detachably secured to the rigid plate, and (4) plunger means comprising a stem having a first end extending freely through and beyond the apertures and a second end integrally formed with a button of wider diameter than the apertures, the button resting freely against the rigid plate and detachably secured to the pliable casing, thereby freely securing the plunger means therebetween, whereby depression of the stem against the pliable casing causes the seal means to become concave for insertion within the shell means and whereby release of the stem causes the seal means to return to its original shape and seal the compartment means within an area of the shell means.

7. The underwater light assembly according to claim 1 wherein the power assembly means includes first and second metal contact patches secured to the compartment means and wherein the on/off switching means comprises a metal contact plate attached to the seal means, whereby when the seal means seals the compartment means within the shell means, the metal contact plate interconnects the metal contact patches and the power assembly means supplies current to the lamp socket means.

8. The underwater light assembly according to claim 7 wherein the power assembly means further includes a first wire running between the lamp socket means and one end of the power assembly means, a second wire running between the lamp socket means and the first metal contact patch, and a third wire running between a second end of the power assembly means and the second metal contact patch.

9. The underwater light assembly according to claim 1 wherein the shell means comprises a transparent dome and further includes a protruding lip attached to the transparent dome and an apron base attached to and extending from the protruding lip, the apron base and the lip extending circumferentially around the transparent dome, the protruding lip providing a surface against which the compartment means is secured and the apron base defining an area outside of the sealed shell area.

10. The underwater light assembly according to claim 9 wherein the apron base includes means defining a plurality of apertures therein for drainage of water from the outside area to assist in submerging the light assembly when placed in a pool of water.

11. The underwater light assembly according to claim 1 wherein the means for detachably securing the compartment means within and against the transparent shell means comprises the detachable seal means.

12. The underwater light assembly according to claim 1 further including means for mounting the underwater light assembly.

13. The underwater light assembly according to claim 1 further including means for preventing rotation of the compartment means within the transparent shell means.

14. The underwater light assembly according to claim 1 wherein the compartment means further includes means for abutting the transparent shell means.

* * * * *